US006833680B2

(12) United States Patent
Choi et al.

(10) Patent No.: US 6,833,680 B2
(45) Date of Patent: Dec. 21, 2004

(54) STRUCTURE OF ELECTRON GUN FOR COLOR CATHODE RAY TUBE

(75) Inventors: Jin Yeal Choi, Gumi-si (KR); Jun Ho Bae, Daegu-si (KR)

(73) Assignee: LG. Philips Displays Korea Co., Ltd., Gumi (KR)

( * ) Notice: Subject to any disclaimer, the term of this patent is extended or adjusted under 35 U.S.C. 154(b) by 0 days.

(21) Appl. No.: 10/373,686

(22) Filed: Feb. 27, 2003

(65) Prior Publication Data

US 2003/0160566 A1 Aug. 28, 2003

(30) Foreign Application Priority Data

Feb. 28, 2002 (KR) ..... 10-2002-0010990
Jul. 25, 2002 (KR) ..... 10-2002-0043746

(51) Int. Cl.[7] ..... H01J 29/58
(52) U.S. Cl. ..... 315/382.1; 313/414; 313/412
(58) Field of Search ..... 315/382, 382.1, 315/3, 14, 13, 15, 5.14; 313/414, 412, 413, 446, 447, 448, 449

(56) References Cited

U.S. PATENT DOCUMENTS 5,221,875 A * 6/1993 Odenthal ..... 315/14
6,163,105 A * 12/2000 Park et al. ..... 313/460
6,288,482 B1 * 9/2001 Watanabe et al. ..... 315/382
6,407,491 B1 * 6/2002 Noguchi et al. ..... 313/414
6,664,725 B2 * 12/2003 Shiroishi et al. ..... 315/382.1
6,674,227 B2 * 1/2004 Kim et al. ..... 313/414

FOREIGN PATENT DOCUMENTS

EP 0 691 672 A1 * 1/1996
JP 08-203446 A 8/1996
JP 10-012155 A 1/1998

* cited by examiner

*Primary Examiner*—Hoanganh Le
*Assistant Examiner*—Ephrem Alemu
(74) *Attorney, Agent, or Firm*—Birch, Stewart, Kolasch & Birch, LLP

(57) ABSTRACT

A structure of an electron gun for a color cathode ray tube capable of reducing a drive voltage by creating an optimum relation among a cathode, a first electrode, and a second electrode mounted in the electron gun, and preventing degradation in response to input signals on a high-resolution screen and a focus characteristic.

47 Claims, 15 Drawing Sheets

$0.06mm^2 \leq S=\pi r^2 \leq 0.12mm^2$ $0.06mm^2 \leq S= ab \leq 0.12mm^2$ $0.06mm^2 \leq S=\pi ab \leq 0.12mm^2$

STRUCTURE OF ELECTRON GUN FOR COLOR CATHODE RAY TUBE

BACKGROUND OF THE INVENTION

1. Field of the Invention

The present invention relates to a structure of an electron gun for a color cathode ray tube. More particularly, the invention relates to a structure of an electron gun for a color cathode ray tube capable of reducing a drive voltage by creating an optimum relation among a cathode, a first electrode, and a second electrode mounted in the electron gun, and preventing degradation in responsiveness to input signals on a high-resolution screen and a focus characteristic.

2. Background of the Related Art

FIG. 1 is an explanatory diagram of a structure of an electron gun for a cathode ray tube in a related art, and FIG. 2 is an explanatory diagram of an outward appearance of the electron gun in FIG. 1.

To give more details on the structure and functions of the electron gun for the cathode ray tube with reference to FIGS. 1 and 2, the electron gun includes three mutually independent cathodes 62, a first electrode (G1) 64 positioned spaced apart for a predetermined distance from the cathode 62, a second electrode (G2) 65, a third electrode (G3) 66, a fourth electrode (G4) 67, a fifth electrode (G5) 68, and a sixth electrode (G6) 69, the second through sixth electrodes being arranged at regular intervals from the first electrode 64 in a tube axis (or in-line) direction wherein a shield cup 70 with a bulb space contact (BSC) 71 adhered thereto is disposed on an upper portion of the last electrode, namely the sixth electrode 69 for electrically connecting the electron gun with a funnel 2 of the cathode ray tube as well as fixing the electron gun to a neck portion 2*a* of the funnel 2.

Also, a deflection yoke 4 for deflecting an electron beam 5 onto the entire screen is installed outside of the neck portion 2*a* of the funnel 2 where the electron gun is mounted on.

Based on the above construction, the electron gun emits electrons when a heater 63 built in the cathode 62 is heated up using the power supplied by a stem pin 61. The electrons existing as the beam shape (i.e. electron beam) are preliminarily converged by a pre-focus lens formed between the first electrode 64 and the second electrode 65, converged later by a pre-main lens formed by a potential difference among the third electrode 66, the fourth electrode 67 and the fifth electrode 68, and finally converged and accelerated when passing a main lens formed by a potential difference between the fifth electrode 68 and the sixth electrode 69.

Basically, an image is formed on the screen when the electron beams 5 are deflected onto the entire screen by the deflection yoke 4 and passes a shadow mask 3 at a predetermined distance from the panel 1 and strikes a fluorescent screen 1*a* formed on an inner surface of the panel 1.

FIG. 3 diagrammatically explains the structure of a part of the electron gun where the electron beam is formed.

As represented in FIGS. 1 through 3, the electron beam 5 is formed on the cathode 62, the first electrode 64 at a predetermined distance from the cathode 62, and the second through fourth electrodes 65, 66, and 67. Normally, the intensity of the electron beam 5 modulates in accordance with image signals applied from an external drive circuit 30, that is, red (Sr), green (Sg), and blue (Sb) colors.

As aforementioned, the first electrode 64 is disposed at a predetermined distance from the cathode 62. And, an electron beam passing hole (or through-hole) with a diameter D is formed on the first electrode 64.

In addition, a thing point 28 is formed between the first electrode 64 and the second electrode 65 where the two electrodes are spaced out by a constant distance B.

Upon application of a constant potential ranging from 400V to 1000V to the second electrode 65, the heater 63 heats the cathode 62, consequently emitting electrons therefrom. The emitted electrons are accelerated toward the first electrode 64 in which they form three electron beams 5, and these three electron beams 5 pass an electron beam passing hole 64A of the first electrode 64 and further an electron beam passing hole 65A of the second electrode 65. Later, these electron beams 5 are preliminarily converged by the pre-focus lens 40 formed between the second electrode and the third electrode 66 to which a 5 to 10 kV high voltage is applied.

The pre-focus lens 40 or the diameter of the pre-focus lens is controlled by the size of the electron beam passing hole 6A of the first electrode 64, the size of the electron beam passing hole 65A of the second electrode 65, a thickness T of the first electrode 64, and the gap B between the first and second electrodes 64 and 65.

Also, a pre-main lens 41 is formed between the third electrode 66 and the fourth electrode 67.

FIG. 4 illustrates another related art cathode ray tube particularly comprising a coining part in the second electrode for reinforcing the pre-focus lens effect.

For instance, a Japanese Patent Publication No. 1999-288664 discloses a cathode ray tube comprising a coining part 65C for adjusting the gap between the second electrode 65 and the third electrode 66, ther by reinforcing the pre-focus lens effect and preventing difficulty of assembly or deterioration in an assembly precision within a limited design system based on an automatic process not necessarily using additional parts.

More specifically, the second electrode 65 is provided with the coining part 65C with a diameter 2R and a thickness t in the vicinity of the electron beam passing hole 65A, and a slot part 65B with a predetermined thickness t1–t2 for improving a focus characteristic of the electron beam.

On the other hand, a drive voltage and a cutoff voltage are different as follows. Usually, the drive voltage from the external drive circuit 30 is applied to respective cathodes corresponding to three-color fluorescent substances through the stem pin 61. When the drive voltage varies, the variation synchronizes with deflection and resultantly the amount of the electron beam 5 emitted from each cathode 62 is controlled thereby. At this time, the voltage right before the electron beam 5 is emitted from the cathode 62 is called a cutoff voltage. Normally, the cutoff voltage is obtained when the brightness of the screen is at zero level (dark point).

To be short, the cutoff voltage clan be expressed by the following equation:

$$\text{Cutoff}=K\times S^3/C\times T\times B)\times Vg2 \qquad \text{Equation (1)}$$

In the equation, K is a proportional constant; S is an area of the electron beam passing hole 64A of the first electrode 64; C is a gap between the cathode 62 and the first electrode 64; T is a thickness of the electron beam passing hole 64A of the first electrode; B is a gap between the first electrode 64 and the second electrode 65; and Vg2 is an applied voltage to the second electrode 65.

Given the applied voltage to the second electrode 65 is 260V, the cutoff voltage for a color monitor cathode ray tube is approximately 55V.

According to Japanese Patent Publication No. 53-18866, a color cathode ray tube for a color television typically has a 0.6 mm diameter first electrode for the electron gun, and the drive voltage for a cathode ray tube particularly in a data processing monitor, e.g. a computer, is approximately 50V, and a current capacity a cathode emits is about 0.3 mA.

This corresponds when the screen of the cathode ray tube is at its recommended brightness level, namely 100 cd/m$^2$.

When brightness, resolution and contrast values are substantially high, it is more likely to get a desirable display area for the color cathode ray tube.

Accordingly, as for the cathode ray tube for a monitor which requires all the above characteristics, one needs to reduce a beam spot size at a high brightness and increase the number of pixels, conforming to the increase in the resolution of a dot pitch of each color for composing the fluorescent screen and the elongation of a display screen.

To reduce the diameter of a beam spot more effectively, one makes the first electrode 64 or an electron beam passing hole of a neighboring electrode smaller and spaces electrodes at more optimal intervals, whereby the diameter of a projected thing point 28 is reduced and the current density of the cathode 62 is increased.

However, when more heat or thermal energy (joule) is applied, it increases the current density of the cathode 62, and this consequently causes electron-emitting substances like barium in a corresponding cathode 62 to be evaporated. In short, if the cathode capacity is deteriorated, the lifespan of the cathode ray tube is shortened as well.

In addition, high resolution of the fluorescent dot pitch and increased number of display screens (or frames) responsive to the screen elongation only deteriorate beam transmittance of a shadow mask. Although one tried to maintain desirable screen brightness by having the cathode emit more current, it only shortened the life of the cathode ray tube much faster.

In the meantime, in order to increase the display frames, frequency of the drive voltage for amplifying image signals applied to the cathode is often increased. In doing so, however, the drive voltage modulates the amplitude of image signals.

For instance, suppose that 2M pixel number corresponding to 1600 dots*1200 lines needs to be displayed out of 1.3M pixel corresponding to 1280 dots*1024 lines. Then, one needs to set a clock frequency of a video bandwidth to be in the range of 150–200 MHz.

However, there is a limitation in a circuit frequency characteristic to amplify the amplitude of an image signal to a designated drive voltage.

FIG. 5 illustrates a drive voltage for obtaining a desirable brightness for the screen. As shown in the drawing, the maximum amplitude of the drive voltage for obtaining the preferable screen brightness is approximately 50V given that the clock frequency of the video bandwidth falls in the range of 150–200 MHz.

Generally, a drive voltage can be expressed by the following equation:

$$\text{Drive voltage} = \text{Cutoff voltage} - \text{cathode voltage} \qquad \text{Equation (2)}$$

FIG. 6 graphically represents a relation between the current capacity and the drive/cutoff voltages. As shown in the drawing, given the same drive voltage, the current capacity is inversely proportional to the cutoff voltage. (i.e. The lower the cutoff voltage is, the more the current is emitted.)

That is, given the same drive voltage, more current is emitted when the cutoff voltage is 30V rather than 50V.

Applying the above to a more practical sense, one can easily think of a computer monitor whose brightness is relatively less brightness than that of a television in general. This problem has been remained unsolved regardless of the fact that the Internet and image media system have been rapidly developed within few decades, and more people are now watching animation through computer monitors rather than televisions.

To be more specific, the brightness of the cathode ray tube is normally dependent on the current capacity of the electron gun. As discussed before, when 260V is applied to the second electrode of the cathode ray tube for a monitor, the cutoff voltage typically ranges from 50V to 55V, which is obviously higher than 30V. Therefore, as demonstrated in FIG. 6, the current capacity emitted when the cutoff voltage is 50–55V is just a half of the current capacity emitted when the cutoff voltage is 30V. In consequence, the brightness was lowered and viewers had to stand watching relatively darker images.

Of course, some monitor manufacturers tried to increase the current capacity by applying an even higher drive voltage to the cathode. Unfortunately though, they had to pay more to increase the drive voltage at a high frequency of a color monitor.

FIGS. 7 and 8 are explanatory diagrams of delay in a reply signal to an input signal. For instance, FIG. 7 demonstrates that when the clock frequency is 150 MHz of a video bandwidth, a time delay occurs as the reply signal ascends or descends.

Similarly, FIG. 8 demonstrates that when the clock frequency is 200 MHz of a video bandwidth, a time delay occurs as the reply signal ascends or descends. One thing different from FIG. 7 is that the time de lay gets worse, compared to that of 150 MHz of the clock frequency, and at the same time some of the amplitude is lost, degrading the input signal.

In consequence, a more accurate input signal cannot be transferred to the cathode, and the advantages of the smaller beam spot are not necessarily reflected on the resolution.

In other words, it gets more difficult to display vertical lines that are directly influenced of a relatively high frequency, i.e. horizontal deflection frequency. As a result thereof, the brightness of the vertical lines gets worse and bright lines flow towards a scanning direction.

Meanwhile, a sufficient drive voltage is obtained for horizontal lines that are directly influenced of a relatively low frequency, i.e. vertical deflection frequency.

Nevertheless, this increases a brightness difference between vertical lines and horizontal lines and resultantly creates unnatural images.

Generally speaking on a drive characteristic of the color cathode ray tube, a cathode voltage is set low at the point of emitting electrons so as to reduce the amplitude of the drive voltage.

In such case, however, the current density at the cathode is also reduced. As such, the beam spot diameter on the screen gets longer and the resolution is degraded.

As an attempt to solve the above problems, Korean Patent No. 308366 disclosed an equation, $D^3 \leqq (1.54\ B+0.17) \times T$ (See FIG. 3), wherein D is an average diameter of the electron beam passing hole 64A in the vertical and horizontal directions of the first electrode 64; B is a gap between the electron beam passing hole 64A of the first electrode 64 and the electron beam passing hole 65A of the second electrode 65; and T is a thickness of an electrode plate of the electron beam passing hole 64A of the first electrode 64.

Still a problem arose especially when the gap between the first electrode 64 and the second electrode 65 was increased to satisfy the above equation. That is, an emission angle at the thing point 28 was increased in such case, and this consequently made the size of the beam spot bigger.

SUMMARY OF THE INVENTION

An object of the invention is to solve at least the above problems and/or disadvantages and to provide at least the advantages described hereinafter.

Accordingly, one object of the present invention is to solve the foregoing problems by providing a structure of an electron gun for a color cathode ray tube capable of implementing a low cutoff voltage without incurring additional costs, thereby increasing a current capacity at a given drive voltage and obtaining a desired focus characteristic, namely satisfying a high resolution both in a high and low current areas.

Another object of the present invention to provide a structure of an electron gun for a color cathode ray tube capable of reducing a drive voltage by creating an optimum relation among a cathode, a first electrode, and a second electrode mounted in the electron gun, and preventing degradation in responsiveness to input signals on a high-resolution screen and a focus characteristic.

The foregoing and other objects and advantages are realized by providing the structure of an electron gun for a color cathode ray tube comprising a fluorescent screen, a shadow mask and the electron gun, in which the fluorescent screen includes a fluorescent film with three-color pixels arranged thereon; the shadow mask is a color selecting electrode positioned adjacent to the fluorescent screen; and the electron gun includes a cathode for emitting three electron beam, a first electrode and a second electrode; and the means for forming the main lens includes a plurality of electrodes for focusing the three electron beams onto the fluorescent screen, wherein an electron beam passing hole (or through-hole) of the first electrode ranges from 0.06 $mm^2$ to 0.12 $mm^2$, and a gap between the first electrode and the second electrode ranges from 0.12 mm to 0.3 mm.

Additional advantages, objects and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

The following detailed description will present a structure of an electron gun for a color cathode ray tube according to a preferred embodiment of the invention in reference to the accompanying drawings.

Provided the current capacity flowing in a cathode is constant, there could be actually several ways to increase the current density of the cathode. For example, one can increase a potential of a second electrode, or place a first electrode closer to the cathode, or reduce the size of an electron beam passing hole (or through-hole) of the first electrode, or narrow the gap (space) between the first electrode and the second electrode, or make the second electrode thinner. As such, the size of a spot formed on a screen is reduced while the current density is increased.

Based on the above methods, the present invention is directed to reduce the size of a spot by increasing the current density while keeping the current capacity constant, reduce a drive voltage, and optimize an emission angle towards the second electrode, thereby improving a focus characteristic.

Figure 9:
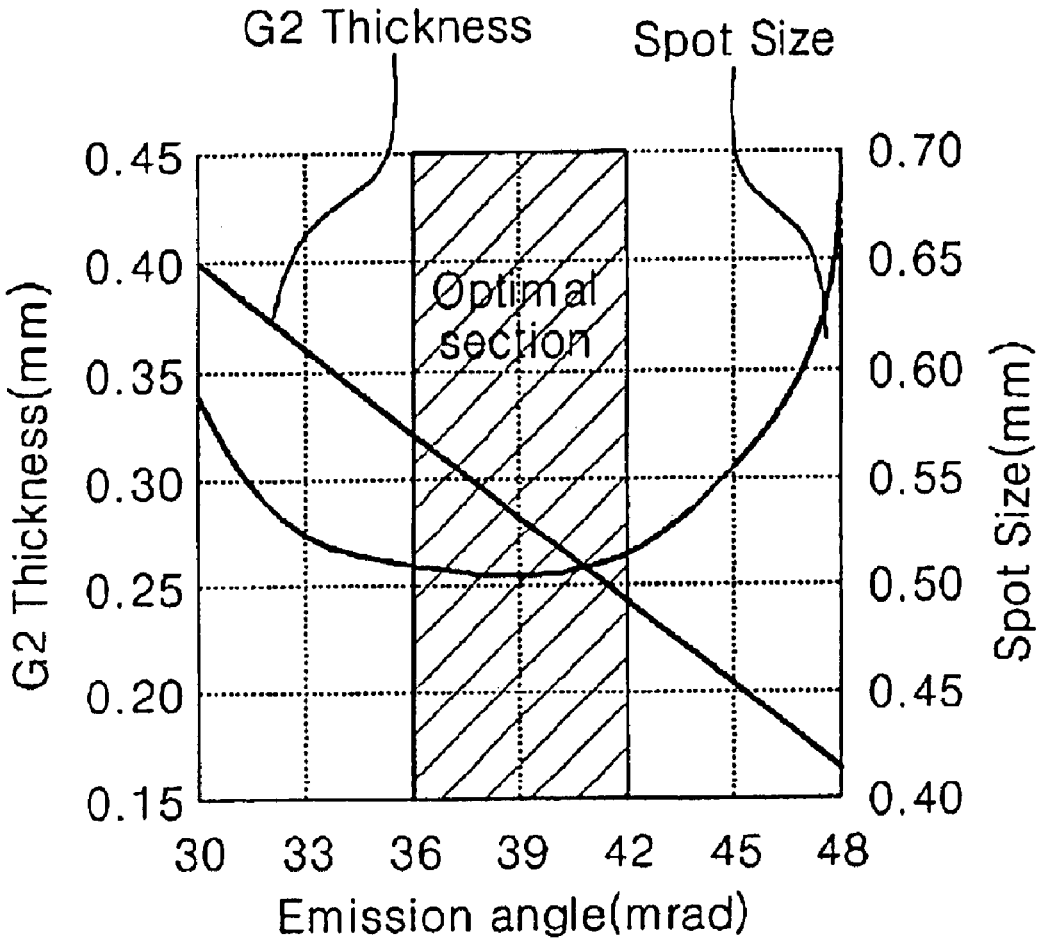
FIG. 9 diagrammatically shows how a spot size varies depending on a variation of a thickness of the second electrode.

FIG. 9 diagrammatically show how a spot size varies depending on a variation of a thickness of the second electrode.

Figure 1:
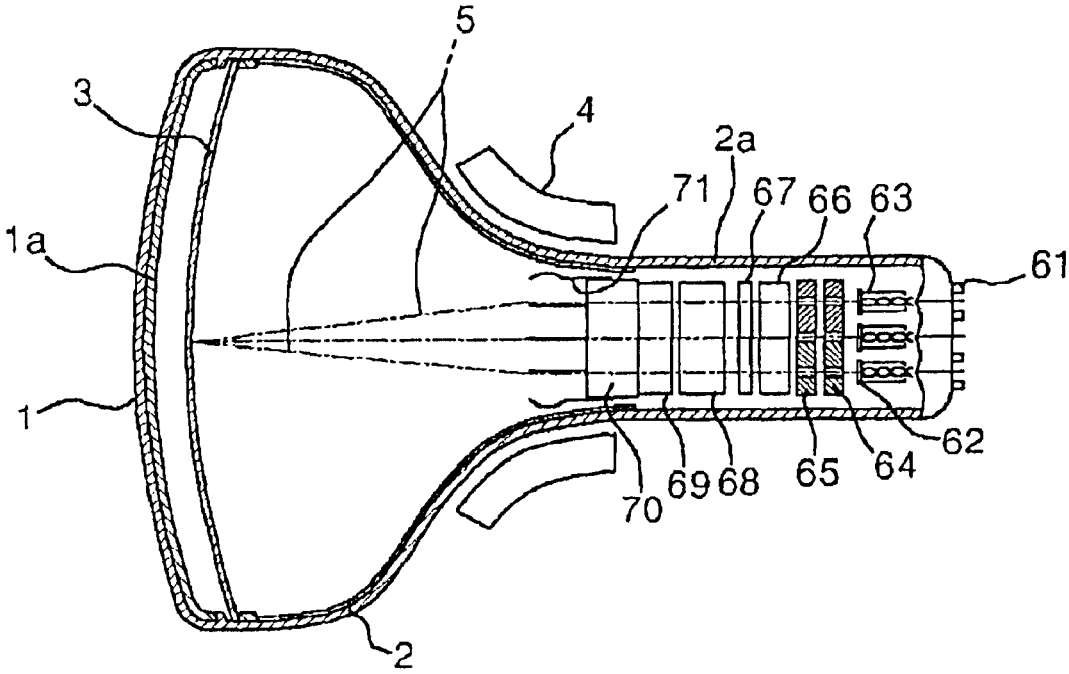
FIG. 1 (Background Art)
FIG. 1 is an explanatory diagram of a structure of an electron gun for a cathode ray tube in a related art.
Figure 2:
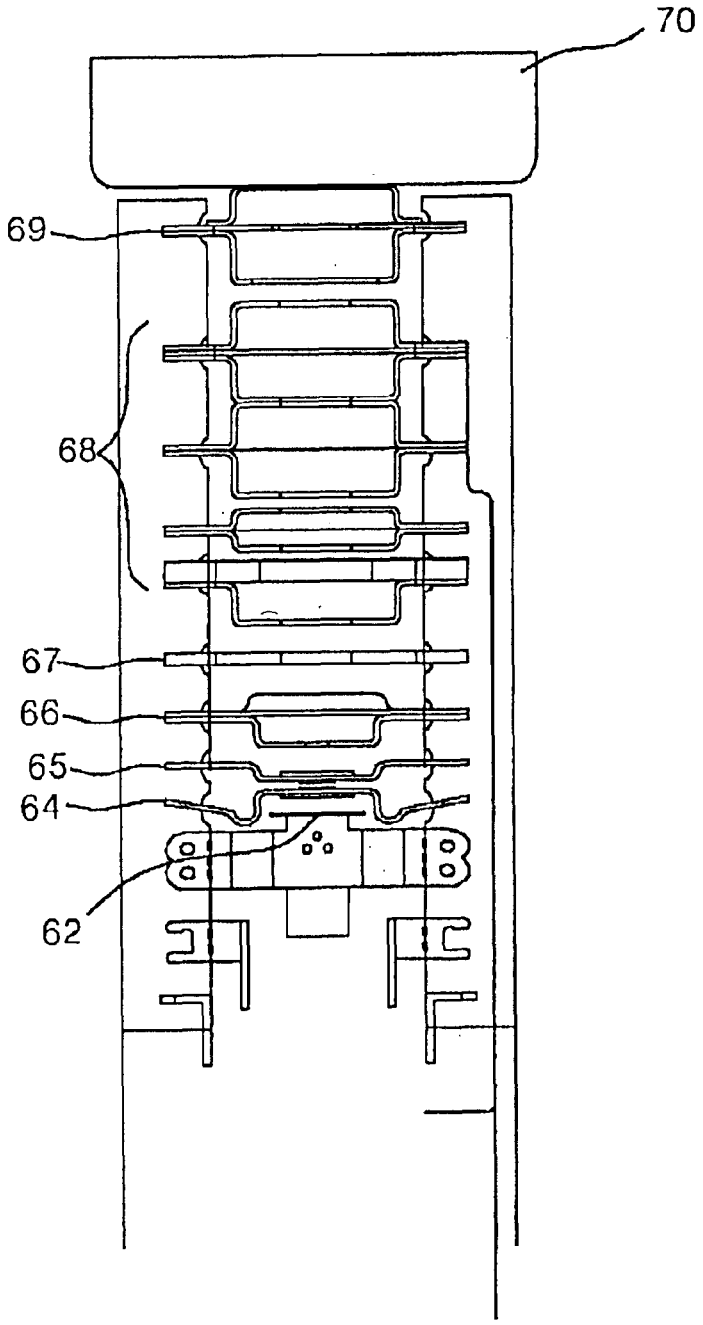
FIG. 2 (Background Art)
FIG. 2 is an explanatory diagram of an outer appearance of the electron gun shown in FIG. 1.
Figure 3:
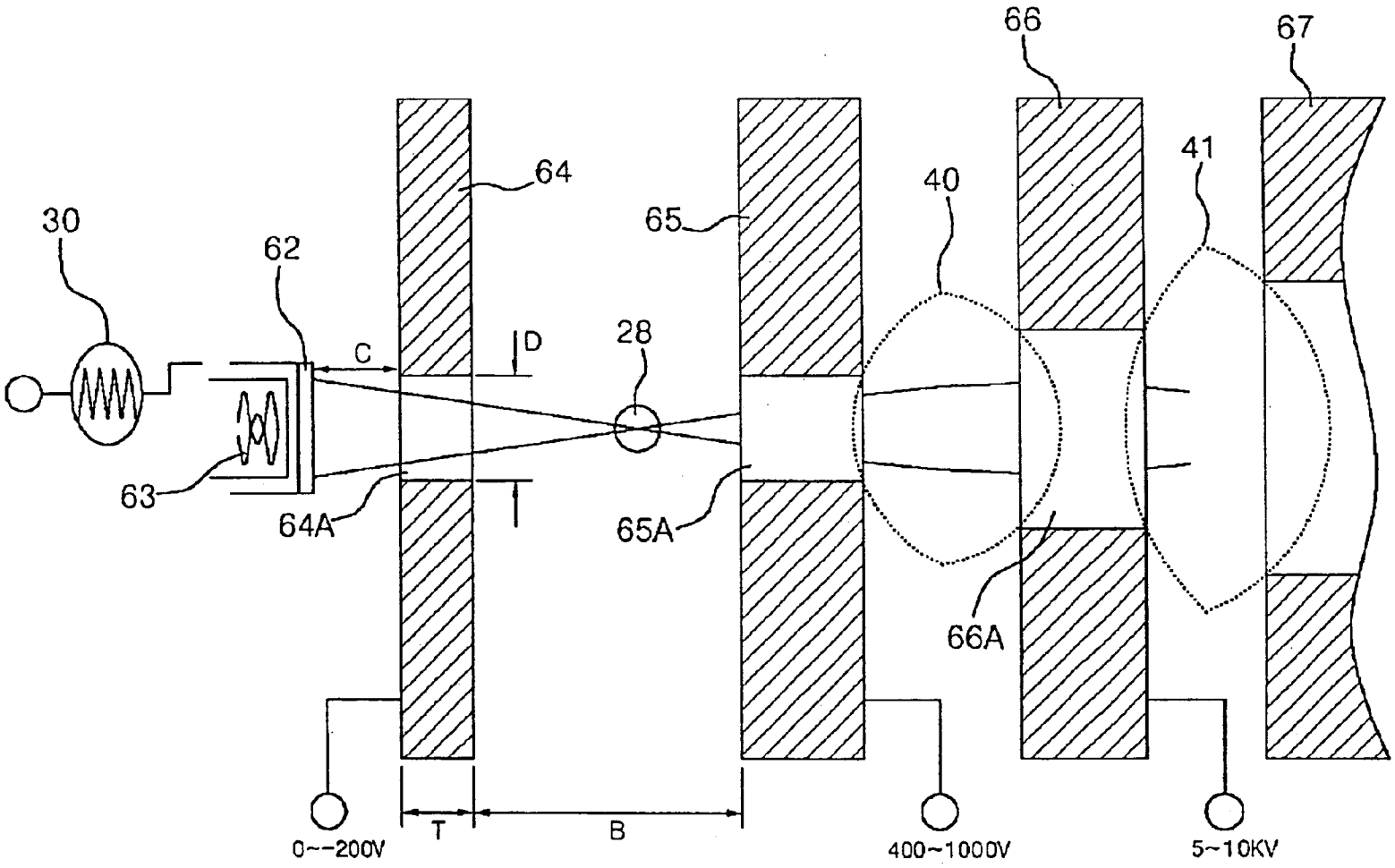
FIG. 3 (Background Art)
FIG. 3 diagrammatically explains a structure of a part of the electron gun where an electron beam is formed.
Figure 4:
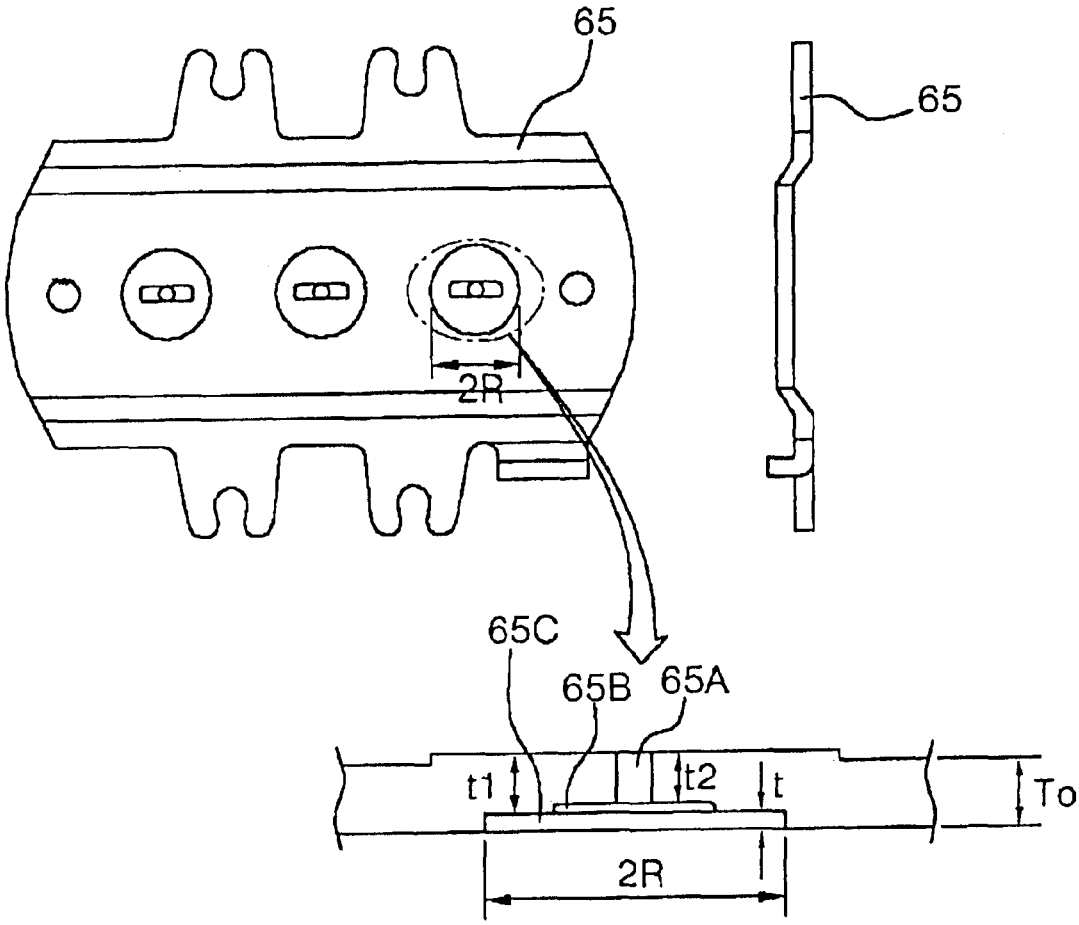
FIG. 4 (Background Art)
FIG. 4 diagrammatically explains a coining part formed on a second electrode so as to reinforce a pre-focus lens effect according to the related art.
Figure 5:
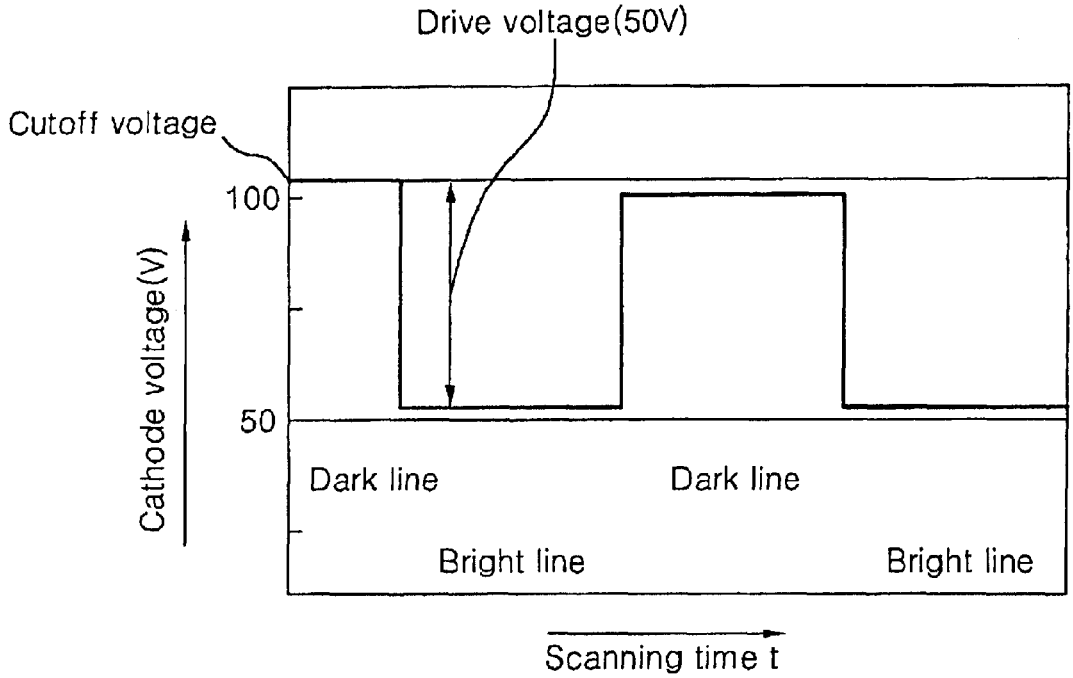
FIG. 5 (Background Art)
FIG. 5 represents a drive voltage for obtaining a desired screen brightness.
Figure 6:
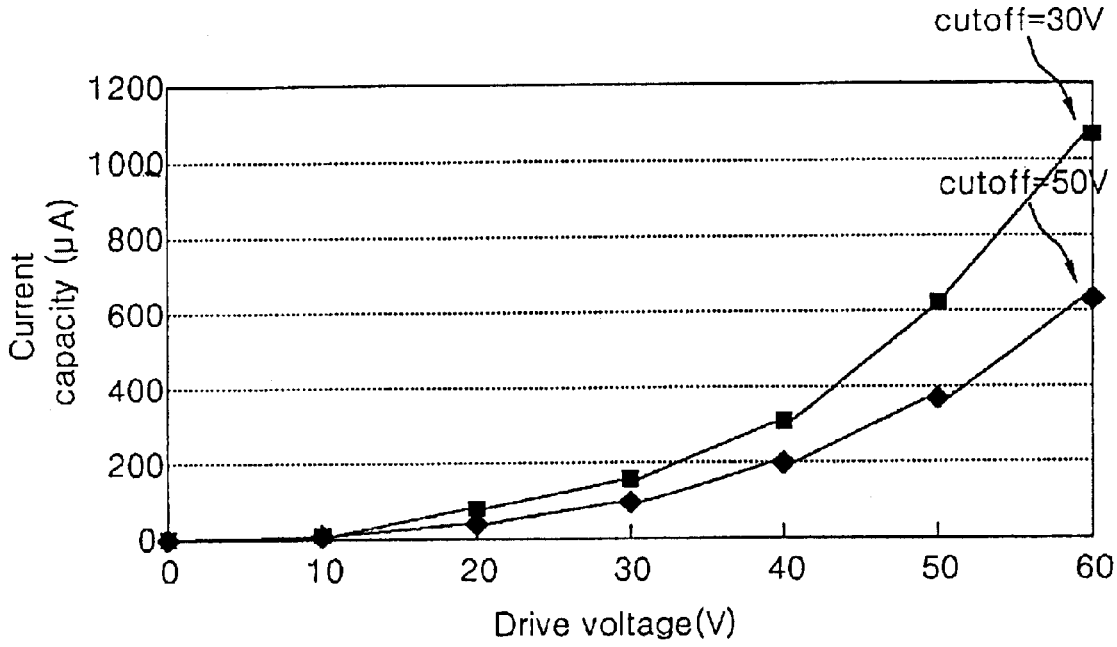
FIG. 6 (Background Art)
FIG. 6 graphically illustrates a relation between a current capacity and drive/cutoff voltages.
Figure 7:
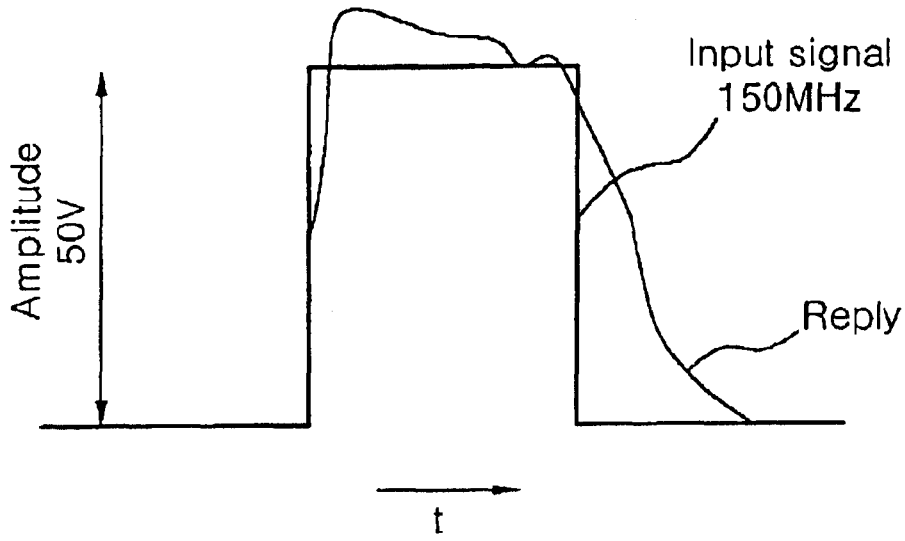
FIG. 7 (Background Art)
FIG. 7 is an explanatory diagram of time delay in a reply signal to an input signal when a clock frequency is 150 MHz of a video bandwidth.
Figure 8:
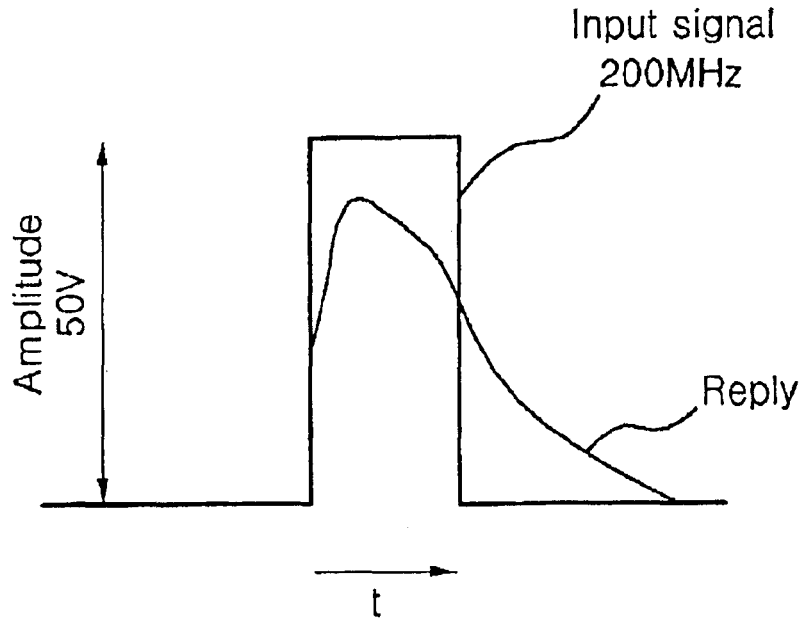
FIG. 8 (Background Art)
FIG. 8 is an explanatory diagram of time delay in a reply signal to an input signal when a clock frequency is 200 MHz of a video bandwidth.

With reference to FIGS. 4 and 9, when the thickness of the second electrode 65 is reduced, a pre-focus lens (40 of FIG. 3) is reinforced, the emission angle is decreased, and the current density is increased.

However, FIG. 9 also illustrates that when the second electrode gets thinner, the spot size gets smaller at first but it again gets bigger after a certain range.

It is found that the spot size is minimum when the emission angle before an incidence of a pre-main lens ranges from 36 mrad to 42 mrad and the thickness of the second electrode 65 is below 0.3 mm.

However, considering that a thickness (To) of a raw material for the second electrode is usually below 0.5 mm, one cannot simply reduce the thickness (To) of the raw material because this consequently gives rise to physical deformation or changes in thermal expansion characteristics. Further, as the gap between the first electrode 64 and the second electrode 65 varies, the cutoff voltage varies as well.

Therefore, to prevent these problems, it is more preferable to vary a depth of a coining part 65C formed on the second electrode 65.

Figure 10:
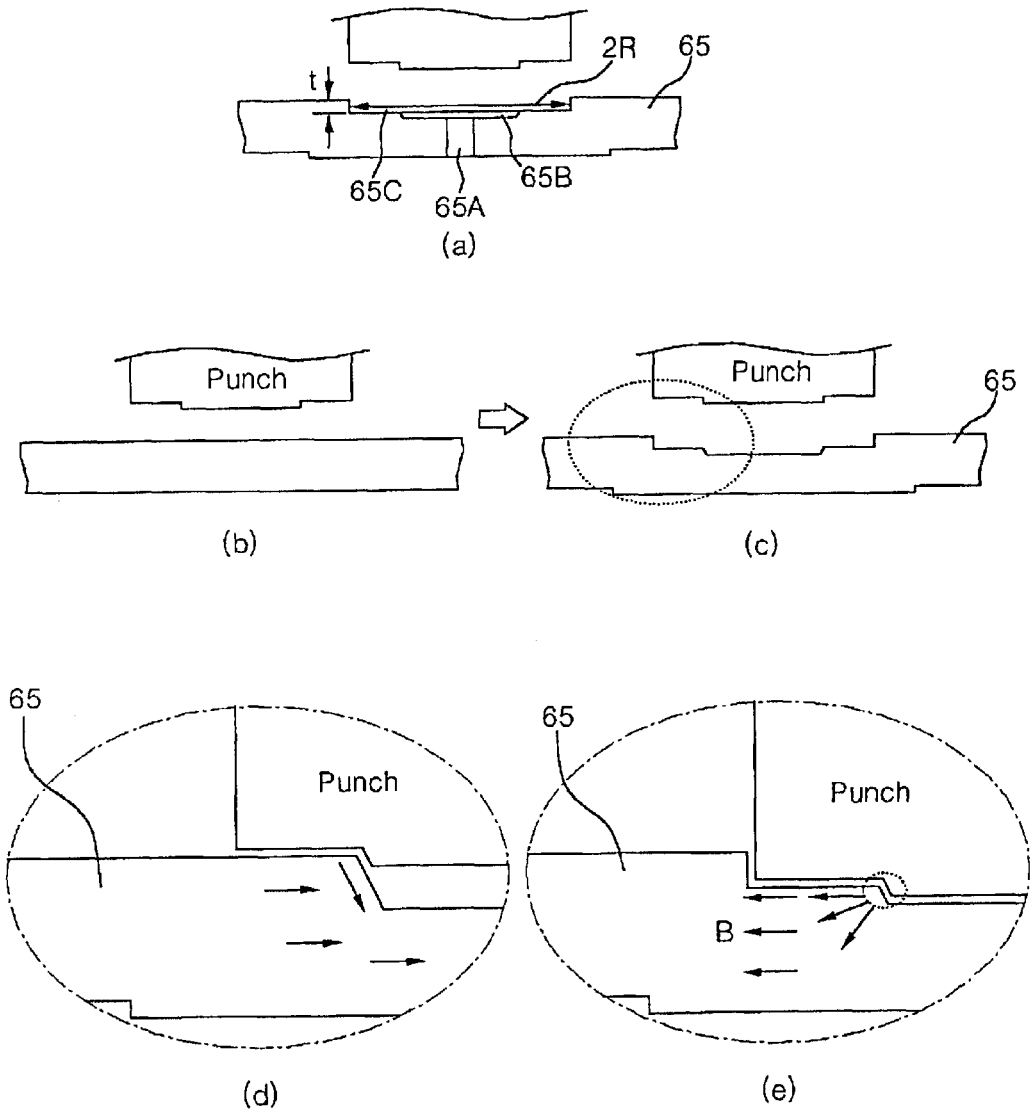
FIG. 10 diagrammatically represents a formation of the coining part on the second electrode.

As illustrated in FIG. 10(*a*), a press patterning punch is utilized for forming desired pattern of the coining part 65C on the second electrode 65, in which a raw material is first pressed by a press patterning punch, as shown in FIG. 10(*b*), to get a desired size (FIG. 10(*c*)).

More specifically, when the raw material is first pressed by the punch to form a slot part 65B, as shown in (d), then metallic structures move in an arrow direction due to the nature of a metal.

Thereafter, as shown in FIG. 10(*e*), the metallic structures are pushed backward in the arrow direction P when a portion for forming the coining part 65C is pressed by the punch.

In this manner, one can obtain the coining part 65C with a wanted thickness. One thing to be careful though is that the coining part 65C for minimizing the spot size should not be too deep because it might cause a problem during a manufacturing process of parts.

Figure 11:
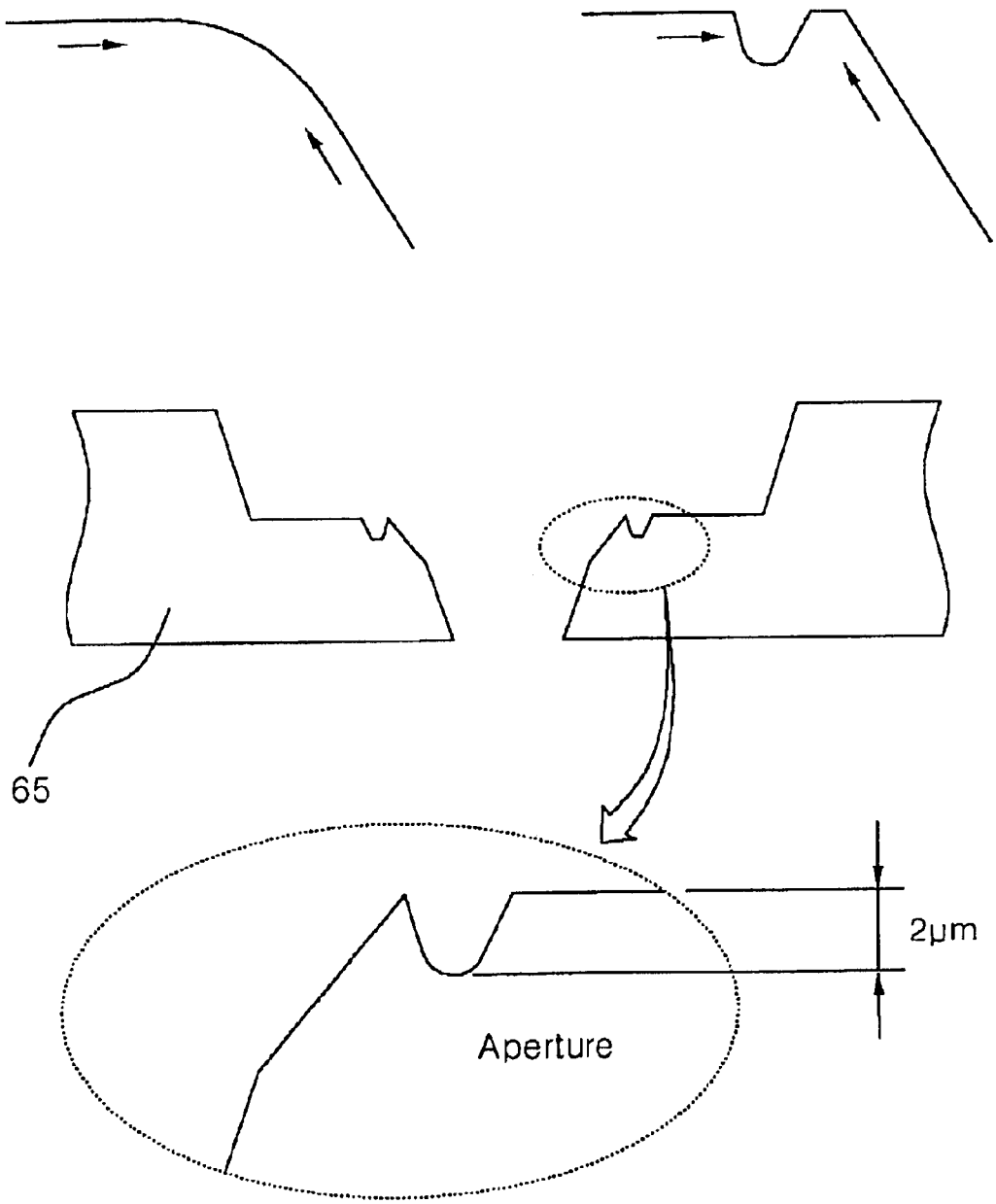
FIG. 11 is an explanatory diagram of an aperture on a boundary surface for forming a slot part.

That is, if the depth (t) of the coining part 65C gets lower, the metallic structures are pushed more severely and an aperture in depth of an about 2 $\mu$m is created on the boundary surface for forming the slot part 65B as shown in FIG. 11. In result, the aperture deteriorates the focus characteristic.

The phenomenon discussed above usually occurs when the amount of forging exceeds 40% of the thickness of the raw material.

Therefore, when the thickness of the raw material of the second electrode 65 is 'To' and the depth of the coining part 65C formed on the second electroe 65 is 't'. Then, the 'To' and 't' preferably satisfy the relation: $t \leqq 0.4 \times To$. But, in order to minimize the spot size, it is necessary to form a depth of the coining part 65C deeper. Therefore, the 'To' and 't' preferably satisfy the relation: $t \geqq 0.4 \times To$. However, when 'To' and 't' satisfy the relation: $t \geqq 0.4 \times To$, it might cause the problem during a manufacturing process of parts. And, one of the ways to minimizing the occurrence of this problem during the manufacturing process of parts is through controlling the volume of the coining part 65C. That is, the volume of the coining part 65C should be less than the maximum volume of the coining part 65C when the 'To' and 't' satisfy the relation: $t=0.4 \times To$.

Also, provided the diameter is 2R and the thickness of the coining part is t. Then, the volume of the coining part 65C can be expressed by '$\pi \times R^2 \times t$'. Considering that 2R indicates the gap between electron beam passing holes 65A of red (R), green (G), and blue (B), respectively, the maximum should not be greater than 2.8 mm.

Hence, the maximum of the coining part's volume can be expressed by '$0.784 \times \pi \times To$ ($mm^3$)'.

Shortly speaking, the volume of the coining part 65C formed on the second electrode 65, '$\pi \times R^2 \times t$', satisfies the relation of $\pi \times R^2 \times t \leqq 0.784 \times \pi \times To$. Assuming that a problem with a patterning process might exist, a constant value 0.99 can be applied to get a more specific range, such as, the volume of the coining part 65C, '$\pi \times R^2 \times t$', preferably satisfies the relation of $\pi \times R^2 \times t \leqq 0.99 \times 0.784 \times \pi \times To$.

To summarize, R, T, and t are in a relation of $$R^2 \leqq 0.77616 \times To/t. \qquad \text{Equation (3)}$$

In case the amount of forging exceeds 40% of the thickness of the raw material in the process of forming an electrode, the metallic structures inevitably go through a rapid change under the pressure and an aperture is created therefrom. To prevent these problems, the value of 'R' could be adjusted by way of minimizing the degree of distortion in the metallic structures Another way to increase the current density is to adjust the cutoff voltage by making the electron beam passing hole of the first electrode smaller or placing the first and second electrode closer. As mentioned before, the cutoff voltage can be expressed by the following equation:

$$\text{Cutoff}=K \times S^3/C \times T \times B) \times Vg2 \qquad \text{Equation (4)}$$

In the equation, K is a proportional constant; S is an area of the electron beam passing hole 64A of the first electrode 64; C is a gap between the cathode 62 and the first electrode 64; T is a thickness of the electron beam passing hole 64A of the first electrode; B is a gap between the first electrode 64 and the second electrode 65; and Vg2 is an applied voltage to the second electrode 65. (See FIG. 3.)

The proportional constant K is always constant, and a proper gap between the cathode 62 and the first electrode 64 is roughly 0.1 mm for activating the cathode 62.

Also, the thickness of the electron beam passing hole 64A of the first electrode 64 is set around 0.1 mm, having considered diverse work conditions during the manufacturing process of an electron gun and any possible restrictions on the press patterning.

This means that the size of the electron beam passing hole 64A of the first electrode 64 and the gap B between the first electrode 64 and the second electrode 65 are the crucial or substantial factors for controlling the cutoff voltage in the manufacturing process of electron guns.

Figure 12:
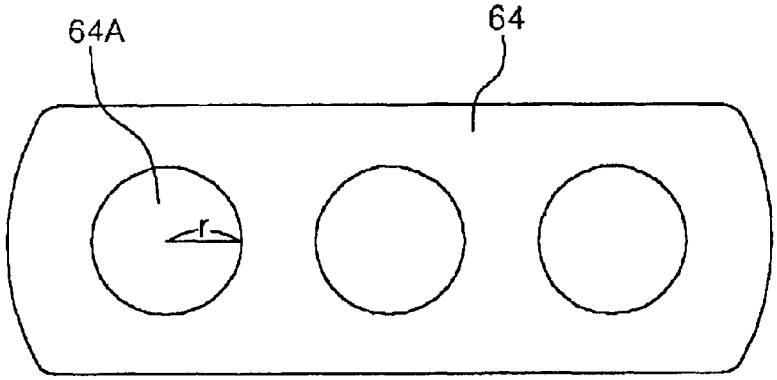
FIG. 12 diagrammatically illustrates shapes of an electron beam passing hole of a first electrode.
Figure 12:
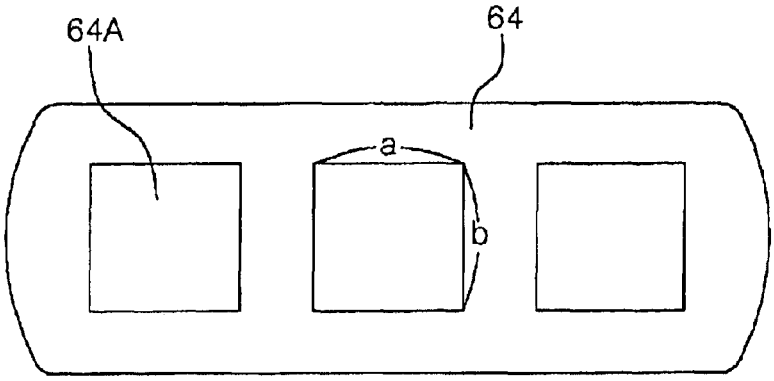
Figure 12:
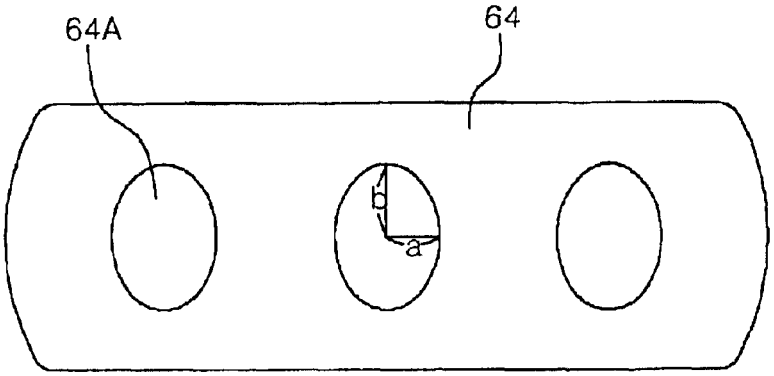

Since the electron beam passing hole 64A of the first electrode 64 exists in different shapes as depicted in FIG. 12, the area (S) of the electron beam passing hole 64A is mostly calculated.

Figure 13:
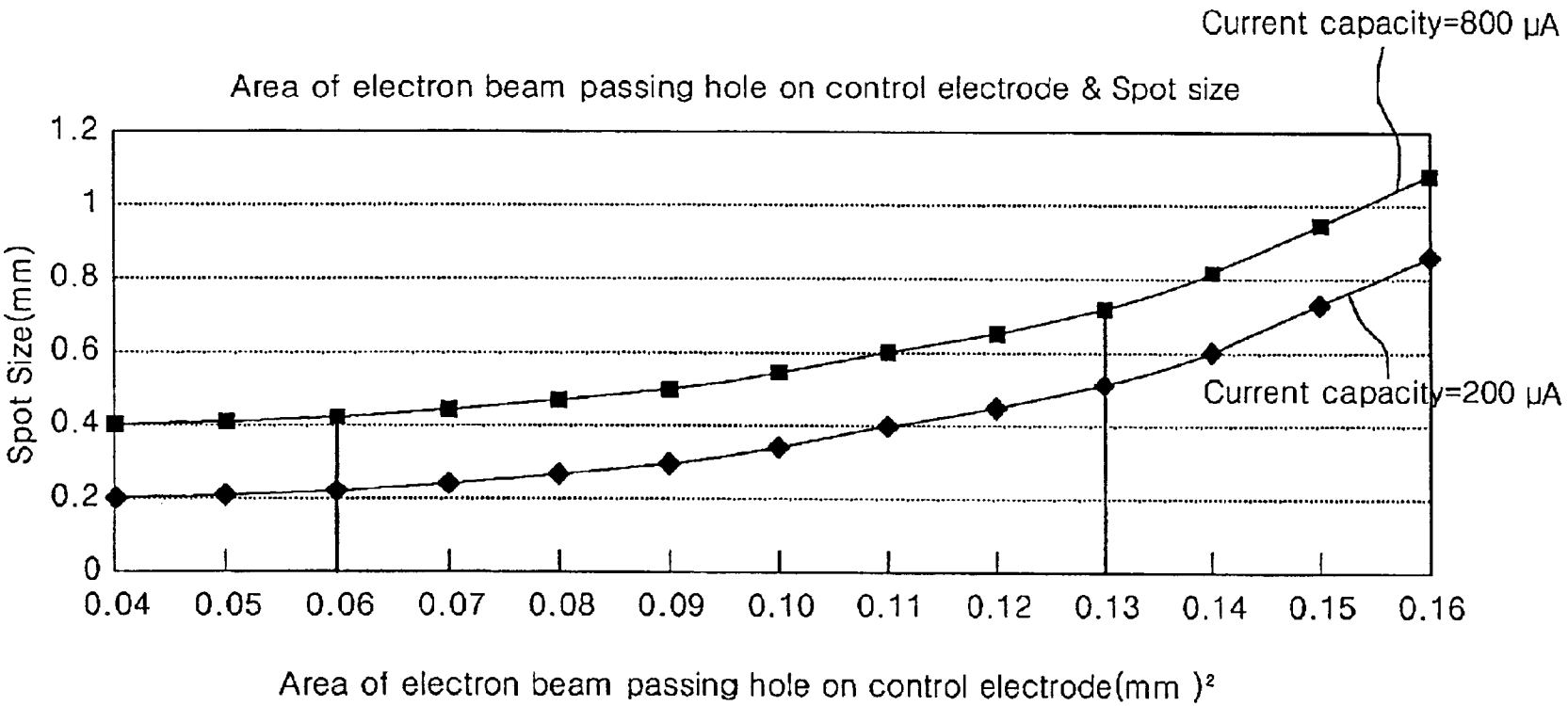
FIG. 13 graphically represents a relation between an area of the electron beam passing hole of the first electrode and a spot size in different current capacities.

FIG. 13 shows a relation between the area (S) of the electron beam passing hole 64A of the first electrode 64 and the spot size in different current capacities. It is found that as the area (S) of the electron beam 64A of the first electrode 64 increases, the spot size gets larger.

As the graph shows, if the are (S) of the electron beam passing hole 64A of the first electrode 64 is below 0.06 $mm^2$, although a very small spot can be made, the patterning process thereof is very difficult and the lifespan of a cathode ray tube therefrom could be problematic. Hence, this case is not possible in reality.

On the other hand, if the area (S) of the electron beam passing hole 64A of the first electrode 64 is above 0.12 $mm^2$, the spot size rapidly increases. This is a fatal cause of a low resolution of the color cathode ray tube and it becomes very hard to reduce the cutoff voltage.

Hence, an appropriate area (S) of the electron beam passing hole 64A of the first electrode 64 is not smaller than 0.06 $mm^2$ and not larger than 0.12 $mm^2$.

Figure 14:
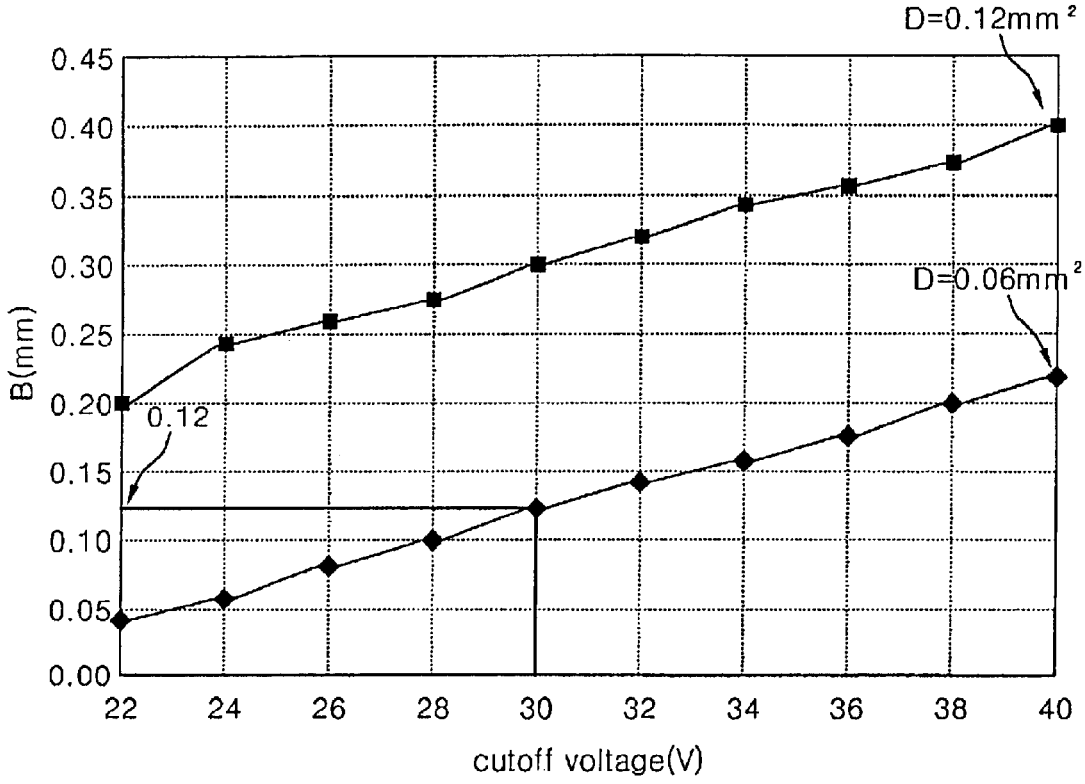
FIG. 14 graphically represents a relation between a gap between the first and second electrodes in accordance with the area of the electron beam passing hole of the first electrode and a cutoff voltage.

FIG. 14 shows a relation between the gap between the first and second electrodes in accordance with the area of the electron beam passing hole of the first electrode and the cutoff voltage.

As depicted in the drawing, in order to adjust the cutoff voltage to 30V, the gap B between the first electrode 64 and the second electrode 65 should be 0.12 mm when the area (S) of the electron beam is 0.06 $mm^2$. Similarly, the gap B between the first electrode 64 and the second electrode 65 should be 0.3 mm when the area (S) of the electron beam is 0.12 $mm^2$.

As such, the cutoff voltage can be reduced down to 30V by adjusting the size of the electron beam passing hole 64A of the first electrode 64 and the gap (B) between the first electrode 64 and the second electrode 65. This means that it is now possible to obtain a focus characteristic for satisfying the resolution both in a low current area and a high current area.

In the meantime, the gap (C) between the cathode 62 and the first electrode 64 should be as small as possible so as to increase the current density of the cathode.

However, one should not overlook the fact that the cathode is heated up to a considerably high temperature as it is activated in vacuum. In fact, the temperature is about 140% higher than the temperature the cathode 62 obtained from a heater 63 for a normal operation.

Accordingly, to prevent the cathode 62 from being expanded from a high heat, the cathode 62 and the fist electrode 64 should be spaced out for a predetermined distance from each other.

Assuming that the cathode 62 is cooled, a proper gap between the first electrode 64 and the cathode 62 is at least 0.1 mm or higher.

It has been discussed before that reducing the cutoff voltage also lowers the drive voltage and further increases the current density of the cathode.

A typically used method for lowering the cutoff voltage is designating the potential for the first electrode 64 as low as possible. However, this method proved useless because it cannot maintain a wanted current density and consequently enlarges the spot size.

As an alternative, the diameter of the electron beam passing hole 64A of the first electrode 64 is shortened and the current density is maintained.

In addition, if necessary, the fir st electrode 64 and the second electrode 65 should be spaced out farther than the predetermined distance in order to solve discharge or leakage problem caused by the potential difference of respectively applied voltages or prevent any foreign substance from getting into the gap between the electrodes.

Figure 15:
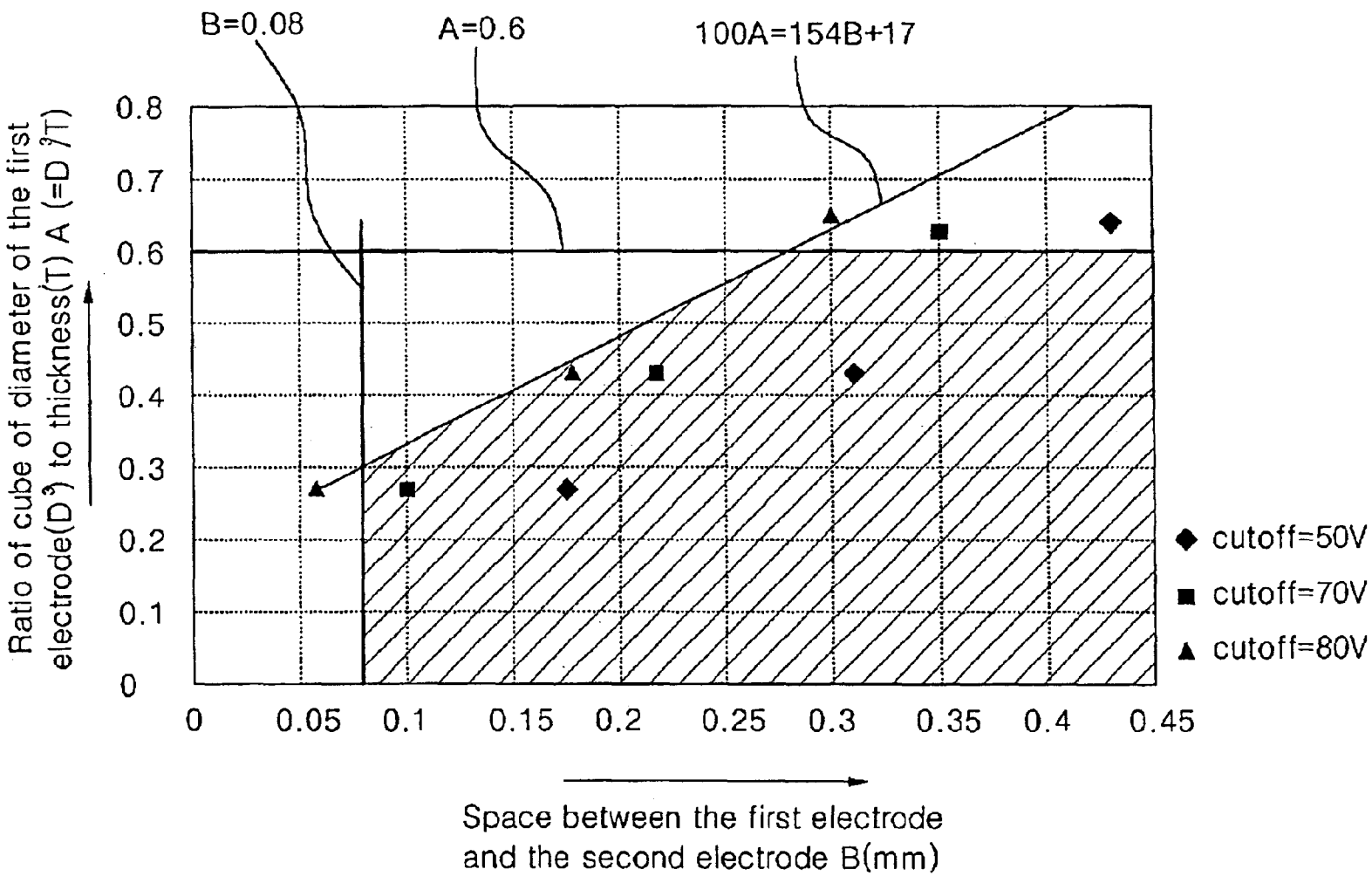
FIG. 15 graphically explains a relation among the gap between the first and second electrodes, a diameter of the electron beam passing hole of the first electrode, and a thickness of the electron beam passing hole of the first electrode.

FIG. 15 graphically explains a relation among the gap between the first and second electrodes, a diameter of the electron beam passing hole of the first electrode, and a thickness of the electron beam passing hole of the first electrode.

In FIG. 15, a vertical axis A indicates the ratio of $D^3$ to T, wherein D is an average diameter in the vertical and horizontal directions of the electron beam passing hole 64A of the first electrode 64; and T is a thickness of the electron beam passing hole 64A of the first electrode 64.

In FIG. 15, a horizontal axis B indicates a gap between the electron beam passing hole 64A of the first electrode 64 and the electron beam passing hole 65A of the second electrode 65.

Preferably, B is greater than 0.08 mm to prevent discharge or leakage caused by the potential difference of respectively applied voltages to each electrode, and protect the tube from empirical sized foreign substances.

In addition, the parameters, A, B, D and T are in a particular relation to maintain the desirable current density given the cutoff voltage is under 80V:

$$A=D^3/T, 100A \leqq 154B+17$$

That is, $D^3 \leqq (1.54B+0.17)\times T$ Equation (5).

In the equation, D is an average diameter in the vertical and horizontal directions of the electron beam passing hole 64A of the first electrode 64; and T is a thickness of the electron beam passing hole 64A of the first electrode 64; and B is a gap between the electron beam passing hole 64A of the first electrode 64 and the electron beam passing hole 65A of the second electrode 65.

The equation was proved by the orbital analysis of electron beams.

Further, the average diameter (D) of the electron beam passing hole 64A in the vertical and horizontal directions of the first electrode 64 is preferably shorter than 0.4 mm, having considered the area of the electron beam passing hole 64A formed on the first electrode 64. As discussed in FIG. 13, the preferred value fits best for the color cathode ray tube for a (computer) monitor where high-resolution images with pixel number greater than 2M Pixel is required Also, the thickness (T) of the electron beam passing hole 64A is adjusted to fall in the range of 0.06 mm–0.13 mm so as to form the electron passing hole 64A with a high precision. More preferably, the thickness of the electron beam passing hole 64A is 0.1 mm.

To summarize, to maintain a desired focus characteristic in a color cathode tube for a high-resolution display monitor with the pixel number greater than 2M Pixel, $A\times D^3/T \leqq 0.6$.

In FIG. 15, the area satisfying the above relation is manifested by a shaded portion.

Simply by designating A and B values within the area, one can easily maintain the cutoff voltage and the focus characteristic.

At the same time, it is possible to reduce the drive voltage as well. Therefore, an input signal is now reproduced on the screen more precisely without necessarily enlarging the spot size.

Figure 16:
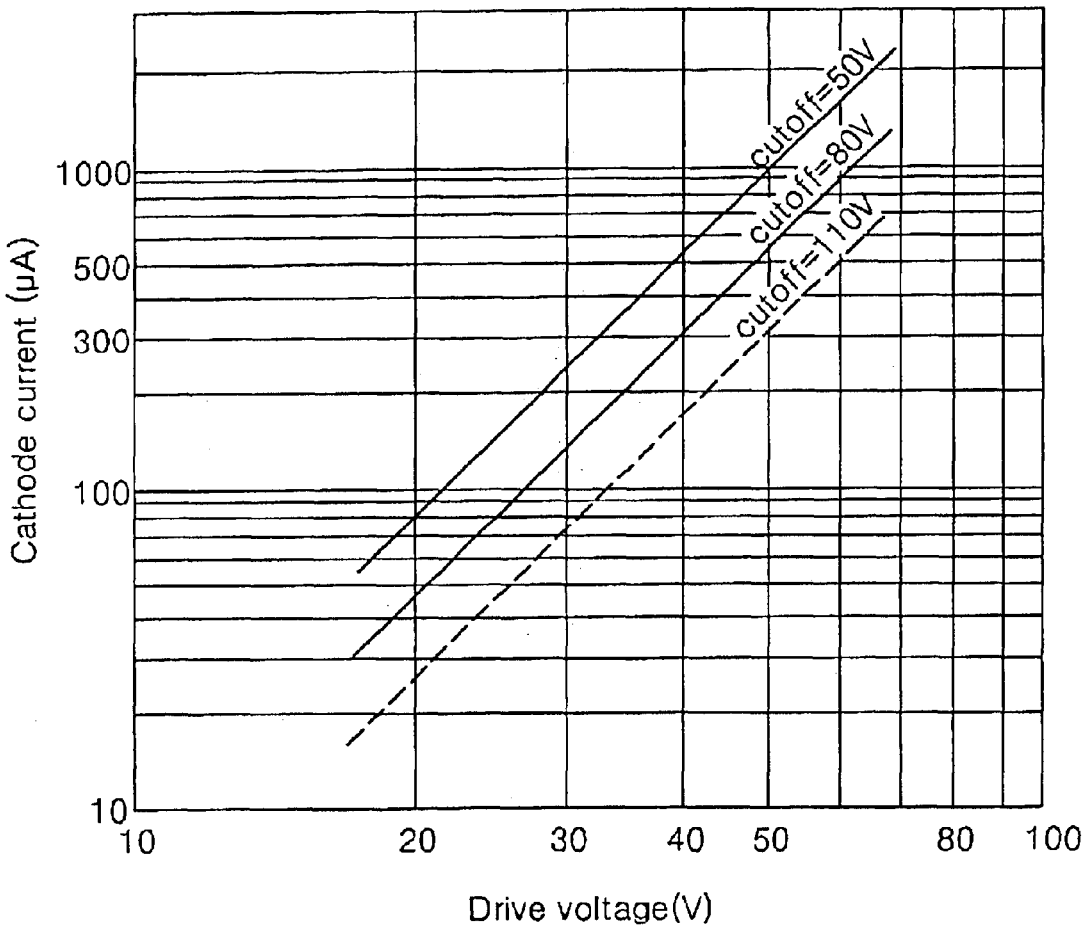
FIG. 16 graphically explains a relation between a drive voltage and a cathode current.

FIG. 16 explains the relation between the drive voltage and the current capacity of the cathode.

As illustrated in the drawing, provided the drive voltage is 40V, the cutoff voltage is below 80V to enable more than about 300 $\mu$A current to flow in one cathode.

To implement the invention, each parameter was given a desirable value. For example, the diameter (D) of the electron beam passing hole 64A of the first electrode 64 was set at 0.3 mm; the thickness (T) of the electron beam passing hole 64A of the first electrode 64 was set at 0.1 mm, the applied voltage to the first electrode 64 was set at 0V; the diameter of the electron beam passing hole of the second electrode 65 was set at 0.37 mm; the applied voltage to the second electrode 65 was set at 600V; the thickness (To) of the raw material for the second material 65 was set at 0.5 mm; the thickness (t) of the coining part 65C of the second electrode 65 was set at 0.2 mm; the gap (B) between the electron beam passing hole (<4A formed on the first electrode 64 and the electron beam passing hole 65A formed on the second electrode 65 was set at 0.12 mm; and the radius (R) of the coining part 65C having considered workability of the second electrode 65 was set at 0.139 mm.

In the above embodiment, the diameter (D) of the electron beam passing hole 64A formed on the first electrode 64, the thickness (T) of the electron beam passing hole formed on the first electrode 64, and the gap (B) between the electron beam passing hole 64A formed on the first electrode 64 and the electron beam passing hole 65A formed on the second electrode 65 are found in the shaded portion, and the cutoff voltage at that time is approximately 70V.

Suppose that the current capacity in each cathode 62 is 300 $\mu$A. Then, a necessary drive voltage, as shown in FIG. 16, is not larger than 40V.

Therefore, the brightness of vertical lines with a video frequency higher than 200 MHz is no longer deteriorated, and the spot size does not need to be enlarged because the emission angle is at its appropriate value, 3.8 mrad.

In conclusion, the electron gun for the color cathode ray tube according to the present invention is capable of implementing a low cutoff voltage without incurring additional costs, thereby increasing a current capacity at a given drive voltage and obtaining a desired focus characteristic, namely satisfying a high resolution both in a high and low current areas.

Moreover, the present invention can be advantageously used in that it creates an optimum relation among a cathode, a first electrode, and a second electrode mounted in the electron gun, and prevents degradation in responsiveness (i.e. slow response) to input signals on a high-resolution screen with a high deflection frequency and a focus characteristic by reducing the drive voltage and appropriately adjusting the emission angle of the pre-focus lens.

While the invention has been shown and described with reference to certain preferred embodiments thereof, it will be understood by those skilled in the art that various changes in form and details may be made therein without departing from the spirit and scope of the invention as defined by the appended claims.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, mean-plus-function clauses are intended to cover the structures described herein as performing the recited function and not only structural equivalents but also equivalent structures.

What is claimed is:

1. A structure of an electron gun for a color cathode ray tube comprising a fluorescent screen, a shadow mask and the electron gun, wherein the fluorescent screen includes a fluorescent film with three-color pixels arranged thereon;

the shadow mask is a color selecting electrode positioned adjacent to the fluorescent screen;

the electron gun includes a cathode for emitting three electron beam, a first electrode and a second electrode; and the means for forming the main lens includes a plurality of electrodes for focusing the three electron beams onto the fluorescent screen; and an electron beam passing hole (or through-hole) of the first electrode ranges from 0.06 $mm^2$ to 0.12 $mm^2$, and a gap between the first electrode and the second electrode ranges from 0.12 mm to 0.3 mm.

2. The structure of the electron gun according to claim 1, wherein a thickness, To (mm), of a raw material of the second electrode, a depth, t (mm), of a coining part formed on the second electrode, and a radius, R (mm), of the coining part formed on the second electrode satisfy a relation of $R^2 \leqq 0.77616 \times To/t$.

3. The structure of the electron gun according to claim 1, wherein a fluorescent pixel of red (R), green (G) and blue (B) applied to the fluorescent screen is greater than 2M Pixel.

4. The structure of the electron gun according to claim 1, wherein the thickness of the second electrode of the electrode gun is below 0.3 mm.

5. The structure of the electron gun according to claim 1, wherein a frequency of a drive voltage applied to the cathode of the electron gun is greater than 200 MHz.

6. The structure of the electron gun according to claim 1, wherein a drive voltage applied to the cathode of the electron gun is below 40V.

7. The structure of the electron gun according to claim 1, wherein a brightness of the fluorescent screen is greater than 100 $cd/m^2$.

8. The structure of the electron gun according to claim 1, wherein a current flowing in the cathode of the electron gun is greater than 0.3 mA.

9. The structure of the electron gun according to claim 1, wherein a cutoff voltage of the cathode Of the electron gun is below 80V.

10. The structure of the electron gun according to claim 1, wherein an average diameter in horizontal and vertical directions of an electron beam passing hole of the first electrode is smaller than 0.4 mm.

11. The structure of the electron gun according to claim 1, wherein a gap between the cathode and the first electrode is greater than 0.1 mm.

12. The structure of the electron gun according to claim 1, wherein a coining part is formed on the second electrode.

13. A structure of an electron gun for a color cathode ray tube comprising a fluorescent screen, a shadow mask and the electron gun, wherein the fluorescent screen includes a fluorescent film with three-color pixels arranged thereon;

the shadow mask is a color selecting electrode positioned adjacent to the fluorescent screen;

the electron gun includes a cathode for emitting three electron beam, a first electrode and a second electrode; and the means for forming the main lens includes a plurality of electrodes for focusing the three electron beams onto the fluorescent screen; and a gap between the first electrode and the second electrode ranges from 0.12 mm to 0.3 mm, and a coining part is formed on the second electrode.

14. The structure of the electron gun according to claim 13, wherein a thickness, To (mm), of a raw material of the second electrode, a depth, t (mm), of a coining part formed on the second electrode, and a radius, R (mm), of the coining part formed on the second electrode satisfy a relation of $R^2 \leqq 0.77616 \times To/t$.

15. The structure of the electron gun according to claim 13, wherein a fluorescent pixel of red (R), green (G) and blue (B) applied to the fluorescent screen is greater than 2M Pixel.

16. The structure of the electron gun according to claim 13, wherein the thickness of the second electrode of the electrode gun is below 0.3 mm.

17. The structure of the electron gun according to claim 13, wherein a frequency of a drive voltage applied to the cathode of the electron gun is greater than 200 MHz.

18. The structure of the electron gun according to claim 13, wherein a drive voltage applied to the cathode of the electron gun is below 40V.

19. The structure of the electron gun according to claim 13, wherein a brightness of the fluorescent screen is greater than 100 $cd/m^2$.

20. The structure of the electron gun according to claim 13, wherein a current flowing in the cathode of the electron gun is greater than 0.3 mA.

21. The structure of the electron gun according to claim 13, wherein a cutoff voltage of the cathode of the electron gun is below 80V.

22. The structure of the electron gun according to claim 13, wherein an average diameter in horizontal and vertical directions of an electron beam passing hole of the first electrode is smaller than 0.4 mm.

23. The structure of the electron gun according to claim 13, wherein a gap between the cathode and the first electrode is greater than 0.1 mm.

24. A structure of an electron gun for a color cathode ray tube comprising a fluorescent screen, a shadow mask and the electron gun, wherein the fluorescent screen includes a fluorescent film with three-color pixels arranged thereon;

the shadow mask is a color selecting electrode positioned adjacent to the fluorescent screen;

the electron gun includes a cathode for emitting three electron beam, a first electrode and a second electrode; and the means for forming the main lens includes a plurality of electrodes for focusing the three electron beams onto the fluorescent screen;

a thickness, To (mm), of a raw material of the second electrode and a depth, t, of a coining part formed on the second electrode satisfies a relation of $t \geqq 0.4 \times To$; and a gap between the first electrode, and the second electrode ranges from 0.12 mm to 0.3 mm.

25. The structure of the electron gun according to claim 24, wherein a gap between the cathode and the first electrode is greater than 0.1 mm.

26. The structure of the electron gun according to claim 24, wherein a thickness, To (mm), of a raw material of the second electrode, a depth, t (mm), of a coining, part formed on the second electrode, and a radius, R (mm), of the coining part formed on the second electrode satisfy a relation of $R^2 \leqq 0.77616 \times To/t$.

27. The structure of the electron gun according to claim 24, wherein a slot part is formed on the second electrode of the electron gun.

28. The structure of the electron gun according to claim 24, wherein a fluorescent pixel of red (R), green (G) and blue (B) applied to the fluorescent screen is greater than 2M Pixel.

29. The structure of the electron gun according to claim 24, wherein the thickness of the second electrode of the electrode gun is below 0.3 mm.

30. The structure of the electron gun according to claim 24, wherein a frequency of a drive voltage applied to the cathode of the electron gun is greater than 200 MHz.

31. The structure of the electron gun according to claim 24, wherein a drive voltage applied to the cathode of the electron gun is below 40V.

32. The structure of the electron gun according to claim 24, wherein a brightness of the fluorescent screen is greater than 100 $cd/m^2$.

33. The structure of the electron gun according to claim 24, wherein a current flowing in the cathode of the electron gun is greater than 0.3 mA.

34. The structure of the electron gun according to claim 24, wherein a cutoff voltage of the cathode of the electron gun is below 80V.

35. The structure of the electron gun according to claim 24, wherein an average diameter in horizontal and vertical directions of an electron beam passing hole of the first electrode is smaller than 0.4 mm.

36. A structure of an electron gun for a color cathode ray tube comprising a fluorescent screen, a shadow mask and the electron gun, wherein the fluorescent screen includes a fluorescent film with three-color pixels arranged thereon;

the shadow mask is a color selecting electrode positioned adjacent to the fluorescent screen;

the electron gun includes a cathode for emitting three electron beam, a first electrode and a second electrode; and the means for forming the main lens includes a plurality of electrodes for focusing the three electron beams onto the fluorescent screen;

an average diameter, D, in the vertical and horizontal directions of an electron beam passing hole formed on the first electrode, a thickness, T(mm), of the electron beam passing hole formed on the first electrode, a gap, B(mm), between the electron beam passing hole formed on the first electrode and an electron beam passing hole formed on the second electrode, a thickness, To(mm) of a raw material of the second electrode, and a depth, t, of a coining part of the second electrode satisfy relations of $D^3 \leqq (1.54\ B+0.17) \times T$ and $t \geqq 0.4 \times To$; and a gap between the first electrode and the second electrode ranges from 0.12 mm to 0.3 mm.

37. The structure of the electron gun according to claim 36, wherein a gap between the cathode and the first electrode is greater than 0.1 mm.

38. The structure of the electron gun according to claim 36, wherein a thickness, To (mm), of a raw material of the second electrode, a depth, t (mm), of a coining part formed on the second electrode, and a radius, R (mm), of the coining part formed on the second electrode satisfy a relation of $R^2 \leqq 0.77616 \times To/t$.

39. The structure of the electron gun according to claim 36, wherein a slot part is formed on the second electrode of the electron gun.

40. The structure of the electron gun according to claim 36, wherein a fluorescent pixel of red (R), green (G) and blue (B) applied to the fluorescent screen is greater than 2M Pixel.

41. The structure of the electron gun according to claim 36, wherein the thickness of the second electrode of the electrode gun is below 0.3 mm.

42. The structure of the electron gun according to claim 36, wherein a frequency of a drive voltage applied to the cathode of the electron gun is greater than 200 MHz.

43. The structure of the electron gun according to claim 36, wherein a drive voltage applied to the cathode of the electron gun is below 40V.

44. The structure of the electron gun according to claim 36, wherein a brightness of the fluorescent screen is greater than 100 $cd/m^2$.

45. The structure of the electron gun according to claim 36, wherein a current flowing in the cathode of the electron gun is greater than 0.3 mA.

46. The structure of the electron gun according to claim 36, wherein a cutoff voltage of the cathode of the electron gun is below 80V.

47. The structure of the electron gun according to claim 36, wherein an average diameter in horizontal and vertical directions of an electron beam padding hole first electrode is smaller than 0.4 mm.

* * * * *